United States Patent [19]

Gentiluomo

[11] Patent Number: 4,979,746

[45] Date of Patent: Dec. 25, 1990

[54] GOLF BALL

[76] Inventor: Joseph A. Gentiluomo, 1456 Belmont Ave., Schenectady, N.Y. 12308

[21] Appl. No.: 281,956

[22] Filed: Dec. 5, 1988

Related U.S. Application Data

[63] Continuation of Ser. No. 259,923, May 4, 1981, abandoned.

[51] Int. Cl.[5] ..... A63B 37/06

[52] U.S. Cl. ..... 273/220; 273/230; 273/62

[58] Field of Search ..... 273/218, 235 R, 230, 273/219, 62, 219, 220, 221

[56] References Cited

U.S. PATENT DOCUMENTS

| | | | |
|---|---|---|---|
| 710,755 | 10/1902 | Cavanagh | 273/230 X |
| 786,343 | 4/1905 | De Buren | 273/235 X |
| 790,252 | 5/1905 | DuMahaut | 273/221 |
| 985,741 | 2/1911 | Harvey | 273/230 X |
| 3,313,545 | 4/1967 | Bartsch | 273/218 |
| 3,502,338 | 3/1970 | Cox | 273/218 |
| 3,534,965 | 10/1970 | Harrison et al. | 273/218 |
| 3,572,721 | 3/1971 | Hamson et al. | 273/218 |
| 3,782,730 | 1/1974 | Horchler | 273/230 X |
| 3,883,145 | 5/1975 | Cox et al. | 273/218 |
| 4,090,716 | 5/1978 | Martin et al. | 273/232 |
| 4,123,061 | 10/1978 | Dusbiber | 273/235 R X |

FOREIGN PATENT DOCUMENTS

| | | | |
|---|---|---|---|
| 10463 | 5/1906 | United Kingdom | 273/230 |
| 197804 | 4/1978 | United Kingdom | 273/218 |

*Primary Examiner*—George J. Marlo

[57] ABSTRACT

Two or three piece molded type golf balls having click and feel similar to wound type balls of equal compression. These balls feature an elastic center having a minimum compressibility of at least 10 percent greater than the contacting synthetic elastomer composition which is highly resilient and has a minimum Shore A Durometer hardness of about 70. The softer elastic center such as plastic elastomer or rubber, plastic or rubber foam, natural or composition cork, etc., allows each ball to flatten more under club impact, to reduce likelihood of ball breakage, and provide for excellent click and feel. When the center is made of low density material, more weight is allowed to be concentrated within the outer portion of the ball to provide a ball exhibiting reduced hooking and slicing action when improperly hit.

9 Claims, 1 Drawing Sheet

GOLF BALL

This is a continuation of application Ser. No. 259,923 filed May 4, 1981, now abandoned.

BACKGROUND OF THE INVENTION

This invention relates to an improvement in presently available molded regulation type golf balls.

In order to provide molded golf balls with distance performance comparable to top grade wound type balls, molded type balls have to be made of substantially highly resilient high hardness synthetic elastomer compositions such as, disclosed in U.S. Pat. Nos. 3,313,545; 3,502,338; 3,534,965; 3,572,721; 3,883,145 and 4,123,061. Above cited patents disclose ball material minimum Shore A Durometer hardnesses of $89^{30}$, 100, 95, 90.9, 85 and 90.4 respectively. Due to hardness of cited molded balls, they are more readily hooked and sliced when improperly hit, and their click and feel are not comparable to top grade wound balls.

SUMMARY OF THE INVENTION

The intent of this invention is to so modify construction of presently available molded golf balls such as to reduce breakage rate, to provide click and feel similar to wound type balls, and also to reduce hooking and slicing associated with said molded type balls.

The instant invention teaches that in order to provide presently available molded type balls with better click and feel, and reduced breakage rate, the central portion of said balls must be replaced by a more readily compressible elastic material. In so doing, said balls are allowed to flatten similar to wound balls when hit. This means that ball compression can be adjusted by varying the compressibility of the center with reference to the hardness of the encapsulating material adjacent to said elastic center. Since said elastic material center allows the outer portion of the ball to flatten more under impact, a sharper click sound will prevail when the ball snaps back to its original spherical shape during recovery. Due to the hardness of presently molded balls, club-to-ball impact force is transmitted both through the ball and up the club shaft to give the hard feel disliked by golfers. By using a center having gravity compressibility than the encapsulating mass, the force transmitted through the ball and up the club shaft are substantially dampened. Therefore, transmission of force up the shaft and ball breakage is minimized by the ability of the ball center to absorb shock through substantially increased ball compression.

Several important terms used herein should be construed as follows:

1. Elastic Center—It is defined as a center made of a material which returns to its original spherical shape without external assistance, upon release of the deforming force. Also, it constitutes the innermost element of the ball. Further, it is characterized as having a minimum compressibility of at least 10 percent greater than the adjacent encapsulating material.
2. Compressibility—It relates to the amount of specimen deflection when subjected to a predetermined compressive load. In the instant case, comparison in compressibility is made by comparing the deflection of the spherical elastic center to the deflection of an equal size sphere of the encapsulating material used adjacent to said elastic center. In unitary materials, compressibility is inversely proportional to material hardness.
3. Encapsulating Mass—It is defined to encompass the element or elements surrounding the ball's elastic center.
4. Regulation Golf Ball—It is defined as a ball used for playing the game of golf on standard regulation golf courses.
5. Highly Resilient Synthetic Elastomer Composition—It is defined as any material such as used in the manufacture of the molded solid golf balls disclosed in herein cited prior art patents.

In the practice of the instant invention, it should be noted that the elastic material center can exist as solid plastic elastomer or rubber, foam plastic or rubber, natural cork, composition cork, etc., which are more compressible than the hard molded material used to encapsulate said elastic center. Said encapsulating material adjacent to said elastic center can be made from conventional synthetic elastomer composition such as disclosed in the above cited prior art patents. It should be noted that when the elastic center is made from a light weight material, the density of the molded encapsulating material must be increased through the use of fillers in order to maintain proper ball weight. This essentially means that weight is design-wise removed from the center of a presently available solid molded ball and redistributed within the ball's outer portion. The increased weight within the outer portion of the ball will operate to increase the ball's moment of inertia and cause a reduction in Magnus Effect to a level for effectuating a decrease in ball hooking and slicing action. When a cover is used to encapsulate the ball interior, said cover can be made from conventionally used materials such as balata, Surlyn, Ramlon, and Dynalon, etc.

DESCRIPTION OF THE PREFERRED EMBODIMENTS

I. Two-piece Molded Ball With Rubber Center

Figure 1:
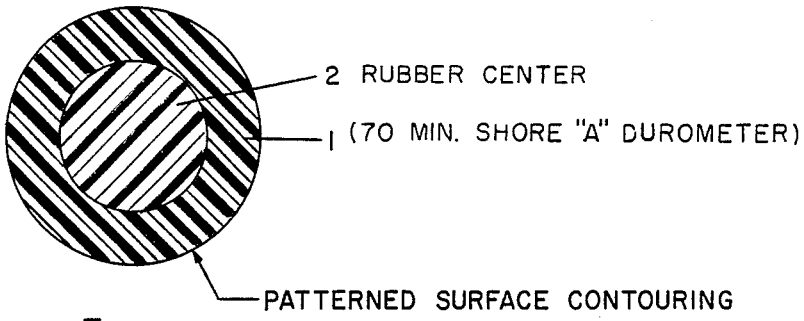
FIG. 1 is a cross sectional view of a two piece molded ball consisting of a rubber center encapsulated by a molded elastomer.

This embodiment is depicted in FIG. 1 and is constructed as a two-piece unit featuring a rubber center 2 encapsulated by a highly resilient molded elastomer 1 having a minimum Shore A Durometer hardness of about 70. Contained within the surface of said molded elastomer 1, is a patterned surface contouring such as dimples.

II. Two-piece Molded Ball With Cork Center

Figure 2:
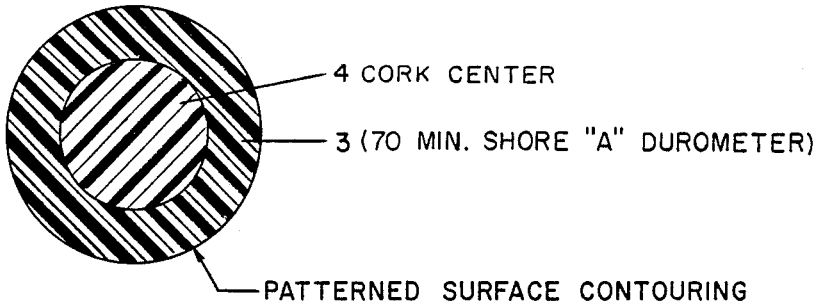
FIG. 2 is a cross sectional view of a two piece molded ball consisting of a cork center encapsulated by a molded elastomer.

This embodiment is depicted in FIG. 2 and is constructed as a two-piece unit featuring a cork center 4 encapsulated by a highly resilient molded elastomer 3 having a minimum Shore A Durometer hardness of about 70. Contained within the surface of said molded elastomer 3, is a patterned surface contouring such as dimples.

III. Three-piece Molded Ball With Rubber Center

Figure 3:
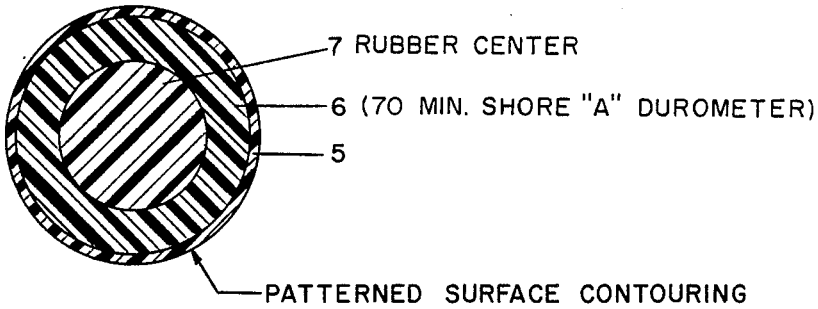
FIG. 3 is a cross sectional view of a three piece ball consisting of a rubber center surrounded by a molded elastomer which has an encapsulating cover.

This embodiment is depicted in FIG. 3 and is constructed as a three-piece unit featuring a rubber center 7 surrounded by a highly resilient molded elastomer 6 having a minimum Shore A Durometer hardness of about 70. Encapsulating said molded elastomer 6, is cover 5 having a patterned surface contouring such as dimples.

IV. Three-piece Molded Ball With Cork Center

Figure 4:
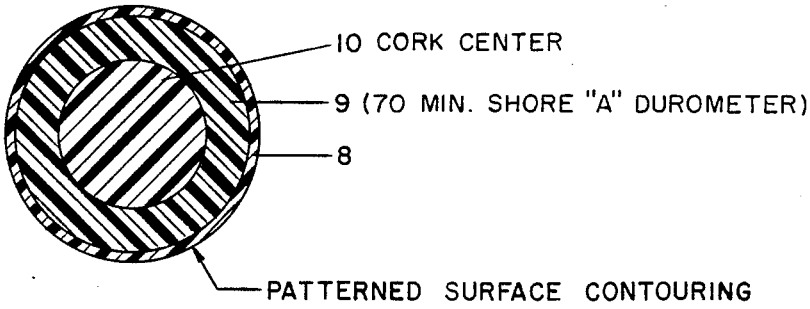
FIG. 4 is a cross sectional view of a three piece ball consisting of a cork center surrounded by a molded elastomer which has an encapsulating cover.

This embodiment is depicted in FIG. 4 and is constructed as a three-piece unit featuring a cork center 10 surrounded by a highly resilient molded elastomer 9 having a minimum Shore A Durometer hardness of about 70. Encapsulating said molded elastomer 9, is cover 8 having a patterned surface contouring such as dimples.

To manufacture golf balls in accordance with the instant invention, conventional processes and techniques presently employed in the art can be used. Therefore, since said processes and techniques are well documented and known, details will not be presented herein.

Having thusly described the invention, the following is claimed:

1. A completely solid regulation golf ball comprising:

(a) an elastic center;

(b) molded encapsulating mass surrounding said elastic center, wherein the material in contact with said elastic center is further characterized as a highly resilient synthetic elastomer composition having a minimum Shore A Durometer hardness of 70;

(c) and patterned surface contouring of predetermined structure contained within the outer surface of said golf ball;

(d) said elastic center having a minimum compressibility of at least 10 percent greater than said material in contact therewith.

2. The golf ball defined in claim 1, wherein said elastic center is further characterized as being made of rubber, and said encapsulating mass is further characterized as a molded elastomer.

3. The golf ball defined in claim 2, wherein said patterned surface contouring is further characterized as surface dimples.

4. The golf ball defined in claim 1, wherein said elastic center is further characterized as being made of cork, and said encapsulating mass is further characterized as a molded elastomer.

5. The golf ball defined in claim 4, wherein said patterned surface contouring is further characterized as surface dimples.

6. The golf ball defined in claim 1, wherein said elastic center is further characterized as being made of rubber, said encapsulating mass is further characterized as composed of a molded encapsulating having an encapsulating cover.

7. The golf ball defined in claim 6, wherein said patterned surface contouring is further characterized as dimples within said cover surface.

8. The golf ball defined in claim 1, wherein said elastic center is further characterized as being made of cork, and said encapsulating mass is further characterized as composed of a molded elastomer having an encapsulating cover.

9. The golf ball defined in claim 8, wherein said patterned surface contouring is further characterized as dimples within said cover surface.

* * * * *

UNITED STATES PATENT AND TRADEMARK OFFICE

CERTIFICATE OF CORRECTION

PATENT NO. : 4,979,746

DATED : Dec. 25, 1990

INVENTOR(S) : Joseph A. Gentiluomo

It is certified that error appears in the above-identified patent and that said Letters Patent is hereby corrected as shown below:

Column 1, line 17; "$89^{30}$" should read -- $89^{+}$--.

Column 1, line 45; "gravity" should read -- greater --.

Column 4, line 24;; "encapsulating" should read -- elastomer --.
(claim 6, line 4)

Signed and Sealed this

Ninth Day of June, 1992

*Attest:*

DOUGLAS B. COMER

*Attesting Officer*

*Acting Commissioner of Patents and Trademarks*